US005699572A

United States Patent [19]

Castle et al.

[11] Patent Number: 5,699,572

[45] Date of Patent: Dec. 23, 1997

[54] COMBINATION CABLE SPREADER AND CABLE DRIVER

[75] Inventors: Brian R. Castle; James J. Scott, both of Rolla, Mo.; John G. Oldsen, Butler, Pa.

[73] Assignee: Jennmar Corporation, Pittsburgh, Pa.

[21] Appl. No.: 645,840

[22] Filed: May 14, 1996

Related U.S. Application Data

[63] Continuation-in-part of Ser. No. 360,261, Dec. 20, 1994.

[51] Int. Cl.[6] ..... B25F 1/00

[52] U.S. Cl. ..... 7/138; 140/123

[58] Field of Search ..... 7/138, 107; 81/121.1; 140/123, 106; 29/461

[56] References Cited

U.S. PATENT DOCUMENTS

| | | | |
|---|---|---|---|
| 1,282,028 | 10/1918 | Bellows | 81/121.1 |
| 2,850,937 | 9/1958 | Ralston | 85/62 |
| 3,226,934 | 1/1966 | Emery | 61/45 |
| 3,478,523 | 11/1969 | Reusser et al. | 61/45 |
| 3,696,599 | 10/1972 | Palmer et al. . | |
| 4,043,690 | 8/1977 | Browne | 403/268 |
| 4,150,473 | 4/1979 | Dietrich | 29/461 |
| 4,265,571 | 5/1981 | Scott | 405/259 |
| 4,378,180 | 3/1983 | Scott | 405/259 |
| 4,469,756 | 9/1984 | Jungwirth et al. | 29/461 |
| 4,673,309 | 6/1987 | Schlaich et al. | 403/265 |
| 4,784,531 | 11/1988 | Calandra | 405/259.6 X |
| 4,798,501 | 1/1989 | Spies | 405/260 |
| 5,189,749 | 3/1993 | Thomas et al. | 7/138 |
| 5,230,589 | 7/1993 | Gillespie | 405/259.6 |
| 5,253,960 | 10/1993 | Scott | 405/302.2 |
| 5,259,426 | 11/1993 | Burleigh et al. | 81/121.1 |
| 5,259,703 | 11/1993 | Gillespie | 405/259.6 |
| 5,375,946 | 12/1994 | Locotos | 405/259.4 |
| 5,378,087 | 1/1995 | Locotos | 405/259.5 |
| 5,417,521 | 5/1995 | Scott | 405/259.6 |
| 5,462,391 | 10/1995 | Castle et al. | 405/302.2 |

FOREIGN PATENT DOCUMENTS

| | | | |
|---|---|---|---|
| 257645 | 3/1988 | European Pat. Off. | 405/259.6 |
| 1608289 | 7/1973 | Germany | 405/302.2 |
| 899997 | 2/1982 | U.S.S.R. | 405/259.6 |

*Primary Examiner*—D. S. Meislin
*Assistant Examiner*—Joni B. Danganan
*Attorney, Agent, or Firm*—Webb Ziesenheim Bruening Logsdon Orkin & Hanson, P.C.

[57] ABSTRACT

The present invention provides a cable driving wrench assembly for thrusting and rotating a multi-strand cable mine rock anchor. The wrench assembly includes a wrench body having an open interior and a plurality of apertures in the wrench body extending into the open interior. Each aperture is adapted to receive an individual strand of the multi-strand cable when the individual strand has been separated from the remaining strands of the cable at least at one end of the cable. The open interior of the wrench body is adapted to receive one end of the cable through the plurality of apertures. A mechanism for thrusting and rotating the wrench body is attached thereto. The present invention additionally includes a cable opening tool for opening the strands of a multi-strand cable. The cable opening tool includes a rotatable tool body and a socket formed in the tool body. The socket is engageable with one end of the multi-strand cable to separate the individual strands from each other at one end of the cable upon rotation of the tool body.

12 Claims, 8 Drawing Sheets

COMBINATION CABLE SPREADER AND CABLE DRIVER

This application is a continuation-in-part of co-pending U.S. patent application Ser. No. 08/360,261 entitled "CABLE ATTACHMENT DEVICE TO SPIN SINGLE CABLES INTO RESINOUS ANCHORS IN BOREHOLES IN GEOLOGIC FORMATION" filed on Dec. 20, 1994.

BACKGROUND OF THE INVENTION

1. Field of the Invention

The present invention relates to a combination cable opening or spreader tool and a cable driver which form a wrench assembly in which a single multi-strand cable is gripped so that it can be rotated into resinous anchorage material in a borehole.

2. Description of the Prior Art

Ground stresses are often released in the creation of underground passages in geologic material. The release of ground stresses often causes strains in the geologic material surrounding the passage. The strain can be reflected by movements of the material and is particularly evident in the roofs and ribs of the passage. Many prior art systems have been developed to resist and restrain the movement of the geologic material to establish stability in the passage. These systems are utilized not only in the roof, but all around the passage. One common type of system is a mine roof bolt such as disclosed by U.S. Pat. No. 2,850,937 to Ralston. This roof bolt includes indicating means conveying information regarding whether or not the roof bolt is supporting the desired load.

U.S. Pat. Nos. 3,226,934 to Emery and 3,478,523 to Reusser et al. are each directed to mine roof bolts which have load bearing plates for use as mine supports. Other relevant patents relating to mine roof bolts, bolt and anchor fixtures include U.S. Pat. Nos. 4,378,180 to Scott; 5,253,960 to Scott and 5,230,589 to Gillespie.

The past practice in the mining industry has been to use a mechanical-type anchor bolt which utilizes a steel heading and threaded rods which are coupled together, if necessary, when the bolt is longer than the seam height. The prior art practice is to use rebar anchored in the resin where anchor problems exist. These systems are still widely used. However, a recent trend in the mining industry is to use cables in place of steel rods or rebars in various support systems as evidenced in some of the above-noted patents. The use of steel cables is particularly advantageous in low seam heights which would otherwise require coupling together various parts of the mine roof bolt and a weakening of the mine roof bolt due to the attached couplings. Furthermore, couplings increase the cost of the bolting assembly, and threads of a rod produce stress concentrations which can weaken the overall support. Cable-type roof bolts, however, can be readily placed in small diameter holes in low seams by bending the cable to obtain insertion and eliminate the couplings. An inherent difficulty with cable-type roof bolts is the difficulty of making an appropriate attachment to the cable which allows the rotation of the cable upon insertion. While attachments can be placed on the cable, such devices with tapered holes and locking jaws or socket connectors tend to be cumbersome, expensive and may interfere with the attachment of other articles to the cable end.

SUMMARY OF THE INVENTION

It is an object of the present invention to overcome the aforementioned drawbacks of the prior art. It is a further object of the present invention to provide a cable rotating wrench assembly in which the wrench includes a series of apertures for entry of individual strand wires to allow for an attachment to thrust and rotate a multi-strand cable of a cable mine rock anchor, such as a roof bolt, into a resinous material which is pushed into a borehole. It is a further object of the present invention to provide a tool to allow quick opening of the individual strands at the end of a multi-strand cable so that the wrench can readily receive the individual strands. A further object of the present invention is to provide and attach a wrench which will easily slide off and quickly release from the cable exposing the bare wire strands of a multi-strand cable in a normally closed position.

The objects of the present invention are achieved by providing a cable driving wrench assembly for rotating a multi-strand cable rock anchor. The wrench assembly of the present invention includes a wrench body having an open interior with a plurality of apertures in the wrench body extending into the open interior. Each aperture is adapted to receive an individual strand of the multi-strand cable of the cable rock anchor when the new strand is separated from the remaining strands of the cable at least at one end of the cable. The open interior of the wrench body is adapted to receive one end of the cable through the plurality of apertures. A mechanism for rotating the wrench body of the wrench assembly is attached to the wrench body.

Further objects of the present invention are achieved by providing a cable opening tool for opening the strands of a multi-strand cable of a cable rock anchor. The cable opening tool includes a rotatable tool body and a socket formed in the tool body. The socket is engageable with one end of the multi-strand cable to separate each individual strand from each other at one end of the cable upon rotation of the tool body in a direction opposite the lay of the cable.

The present invention provides a wrench assembly which includes both the wrench body and the cable opening tool. In one embodiment of the present invention, the cable opening tool is attached to and formed integral with the wrench body. In another embodiment of the present invention, the cable opening tool is formed separate from the cable rotating body and has a handle for manually rotating the tool body. Additionally, the present invention discloses several specific embodiments for formation of the socket of the cable opening tool.

These and other objects of the invention will be clarified in the detailed description of the embodiments taken together with the attached drawings.

BRIEF DESCRIPTION OF THE PREFERRED EMBODIMENTS

Figure 2:
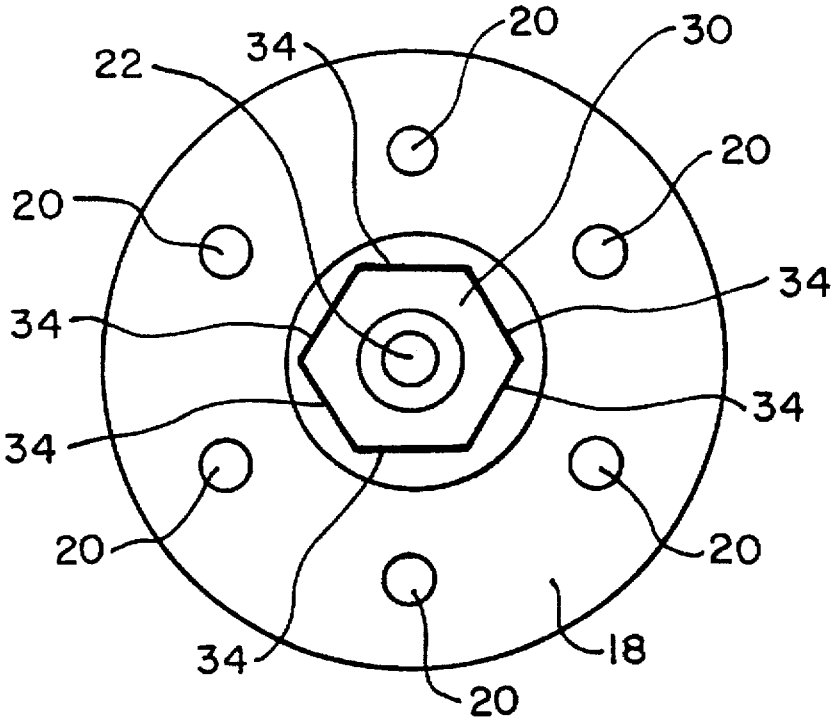
FIG. 2 is a top end view of the cable driving wrench assembly illustrated in FIG. 1.

Current techniques for anchoring cable mine rock anchors, such as roof bolts, in resinous anchor material involve spinning the multi-strand cable to achieve mixing of the anchoring resin material. The present invention relates to a cable wrench assembly adapted for spinning the multi-strand cable of a cable mine rock anchor without the need for additional attachments on the cable. The present invention is a continuation-in-part of co-pending U.S. patent application Ser. No. 08/360,261 which is incorporated herein by reference.

FIGS. 1–5 illustrate a wrench assembly 10 according to a first embodiment of the present invention. The wrench assembly 10 includes a hollow tubular wrench body 12 defining an open interior 14 therein. The wrench body 12 includes a first closed end 16 and a head or second end 18 spaced from the closed end 16 by a cylindrical portion of the wrench body 12. The second end 18 includes six peripheral apertures 20 and a central aperture 22 extending therethrough into the open interior 14. The central aperture 22 is centrally located on the second end 18 with the six peripheral apertures 20 spaced evenly about the central aperture 22. A drive stub 24 is attached to the closed end 16 and may be of a square or hexagonal shape to fit into a corresponding socket of a conventional bolting machine (not shown). The drive stub 24 provides a mechanism for rotating and thrusting the wrench assembly 10 as will be described hereinafter.

Figure 1:
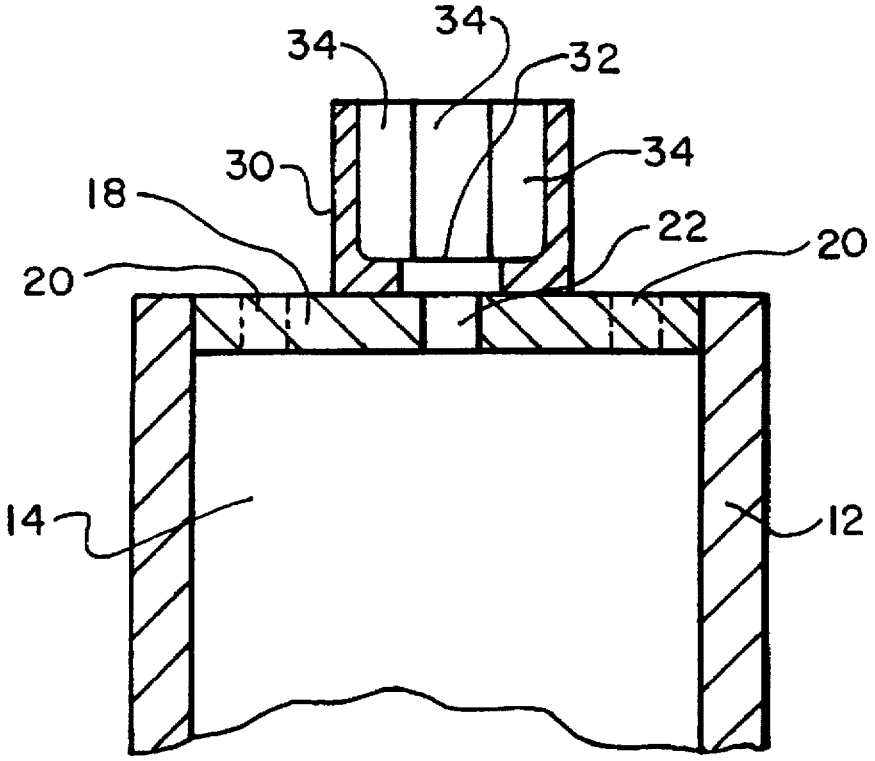
FIG. 1 is a sectional side view of a cable driving wrench assembly according to a first embodiment of the present invention.

The wrench assembly 10 additionally includes a cable opening tool formed integral with the second end 18. The cable opening tool is provided for opening the strands of a multi-strand cable of a conventional cable mine rock anchor as will be described hereinafter. The cable opening tool includes a rotatable tool body 30 attached to the second end 18 of the wrench assembly 10. The tool body 30 includes a socket 32 extending through the tool body 30. The socket 32 is engageable with one end of the multi-strand cable to separate the individual strands from each other at one end of the cable upon rotation of the tool body 30 as will be described hereinafter. The socket 32 is aligned with the central aperture 22 as shown in FIGS. 1 and 2. The socket 32 includes six planar cable engaging faces 34 formed on an upper part thereof as shown in FIGS. 1 and 2.

Figure 3:
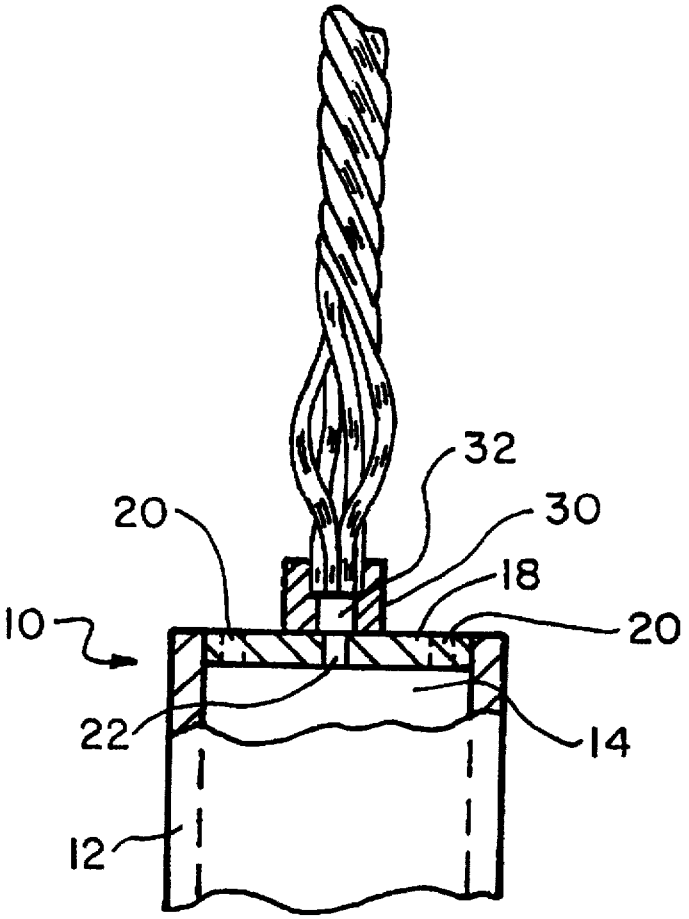
FIG. 3 is a schematic view of a multi-strand cable of a conventional cable mine rock anchor being twisted to open the individual strands thereof by a cable opening tool of the cable driving wrench assembly illustrated in FIG. 1.

The wrench assembly 10 operates as follows. A trailing end of a multi-strand cable is received within the socket 32 of the tool body 30 as shown in FIG. 3. The cable engaging faces 34 will engage with the multi-strands of a conventional cable. A conventional multi-strand cable is generally formed of seven strands with six outer peripheral strands surrounding a central or king strand. Typical multi-strand cable which is utilized in cable mine roof bolt applications is described in ASTM designation A 416. Galvanized cable is also utilized in mine roof bolts. Typical galvanized cable construction is described in ASTM designation A 586.

Figure 4:
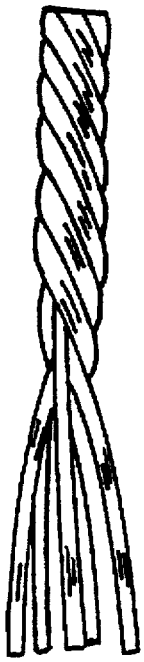
FIG. 4 illustrates the multi-strand cable illustrated in FIG. 3 with the individual strands in the open, unwound position following the use of the cable opening tool of the cable driving wrench assembly illustrated in FIG. 1.

With the trailing end of the multi-strand cable received within the cable engaged in the socket 32, the cable engaging faces 34 will prevent relative rotation between the multi-strand cable and the socket 32. The tool body 30 is then rotated in a direction opposite to the direction of lay of the multi-strand cable with the upper portion of the cable held against rotation. This will begin separation of the individual strands of the cable from each other at the trailing end of the cable as shown in FIG. 3. Once the strands have begun to separate, the cable can be removed from the socket 32 and the separation continued manually to separate the individual strands at the trailing end such that the cable is untwisted as shown in FIG. 4. The rotating of the tool body 30 and the holding of the upper portion of the cable against rotation can both easily be accomplished by hand.

The multi-strand cables are only loosely held together by the frictional forces between the individual strands. In practice, the most significant frictional forces holding a multi-strand cable together are formed at the ends of the cable where the cable is cut. Apparently, during the cutting of the cable, individual burrs are created along the cutting plane of the cable which significantly increase the frictional engagement between the strands. Consequently, a cable opening tool is generally required to begin the unraveling of a multi-strand cable. However, once the process is started, it can be easily continued by hand.

Figure 5:
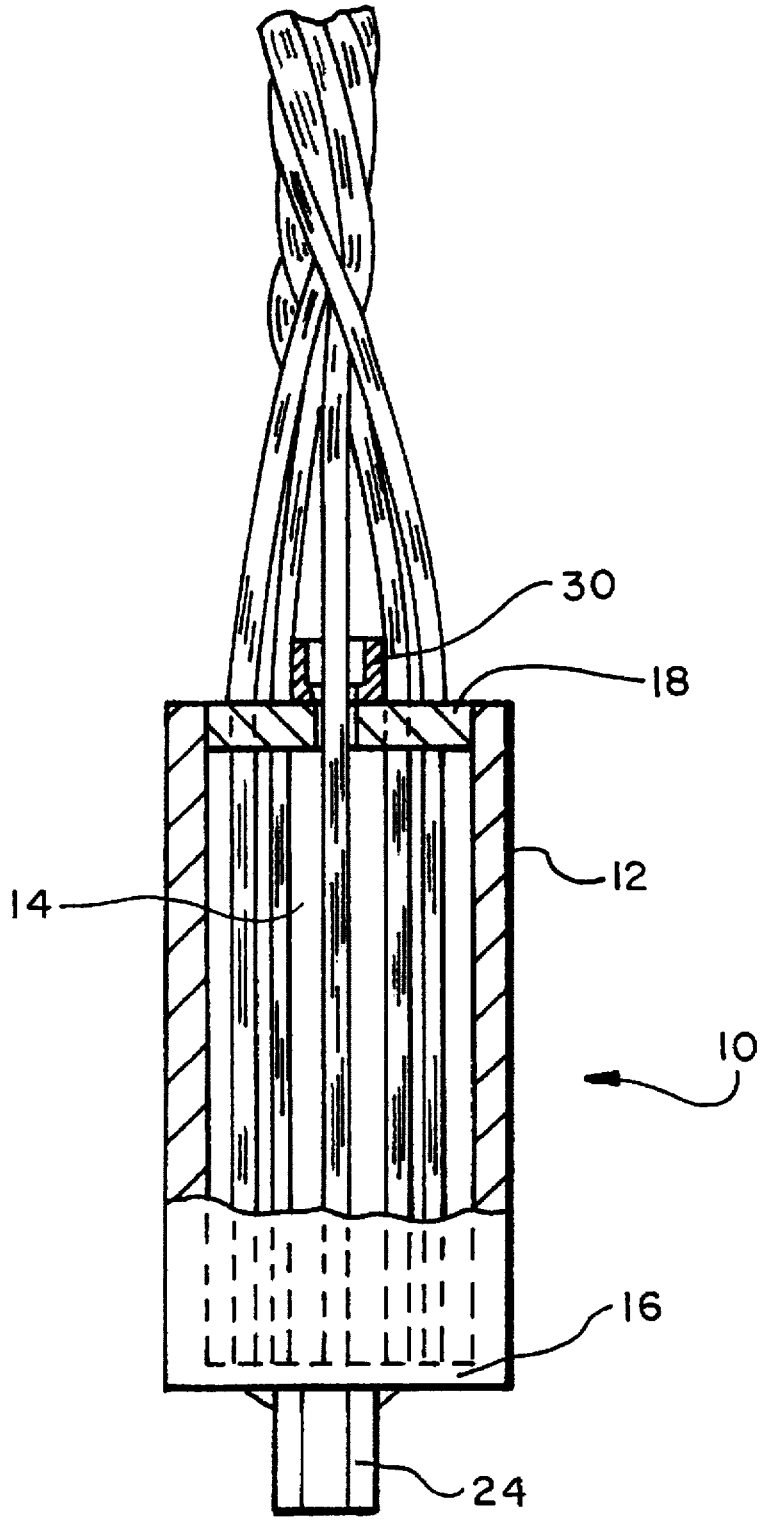
FIG. 5 illustrates the multi-strand cable of FIGS. 2 and 3 inserted into a wrench body of the cable driving wrench assembly illustrated in FIG. 1.

After the individual strands of the cable have been separated, as shown in FIG. 4, the cable can be inserted into the open interior 14 of the wrench assembly 10 by passing each individual strand through a specific aperture 20 or 22 formed in the second end 18 of the wrench assembly 10. This arrangement is illustrated in FIG. 5. The cable is preferably advanced until the individual strands of the trailing end of the cable reach the closed end 16. The wrench assembly 10 can then be advanced and rotated by a conventional bolting machine engaging the drive stub 24 which results in a corresponding advance and rotation of the multi-strand cable. In this manner, the resin cartridges within the borehole can be broken and the resinous material therein appropriately mixed. As shown in FIG. 5, the wrench assembly 10 is preferably rotated in the direction which closes the lay of the multi-strand cable.

The closed end 16 should be spaced sufficiently from the second end 18 such that a significant amount of the cable is received within the open interior 14 to prevent the multi-strand cable from being pulled out of the wrench body 12 during handling or rotation of the multi-strand cable. Applicants found that a length of 15"–30" for the wrench body 12 is more than sufficient to assure that the trailing end of the multi-strand cable is not prematurely removed from the open interior 14 of the wrench body 12 during handling or rotation of the multi-strand cable.

After the resinous material has been appropriately mixed by rotation of the multi-strand cable by the wrench assembly 10, the bolting machine can be stopped and the resin allowed to cure. Following curing of the resinous material, the wrench assembly 10 is removed from the bolting machine and the cable can be removed from the open interior 14 of the wrench body 12 by backing the wrench assembly 10 away from the cable. Preferably, the wrench body 12 is rotated during the backing away from the cable so that the individual strands at the trailing end of the cable can be returned to the normal closed position.

As discussed above, the opening of the individual cable strands at the trailing end of the cable by use of the rotatable tool body 30 is generally a manual operation. To rotate the tool body 30, the user will generally hold on to and turn the wrench assembly 10 utilizing the tubular wrench body 12 essentially as a handle. Consequently, the outer surface of the wrench body 12 may be appropriately roughened or otherwise finished to increase the ability of a user to grip onto the tubular wrench body 12.

Figure 7:
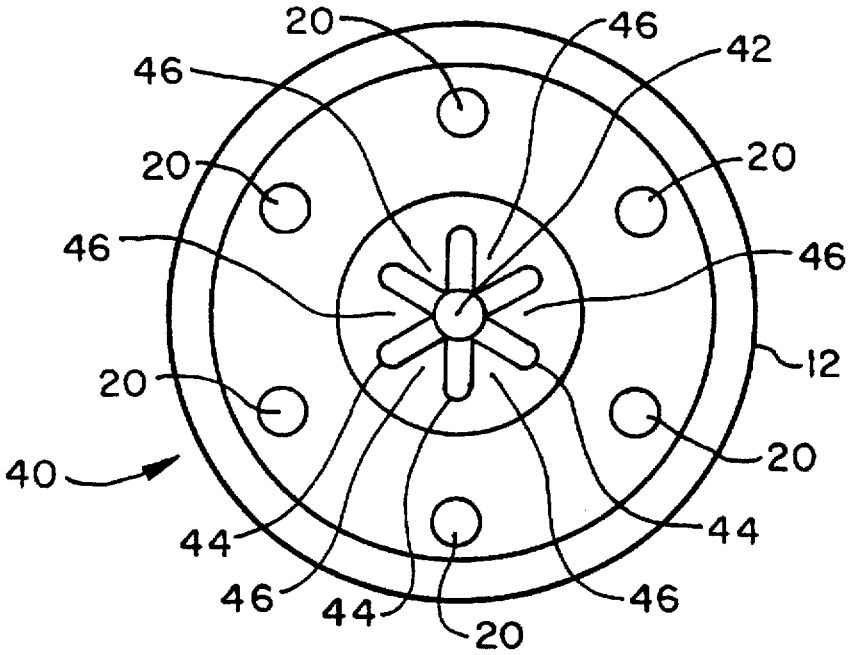
FIG. 7 is a top end view of the cable driving wrench assembly illustrated in FIG. 6.
Figure 6:
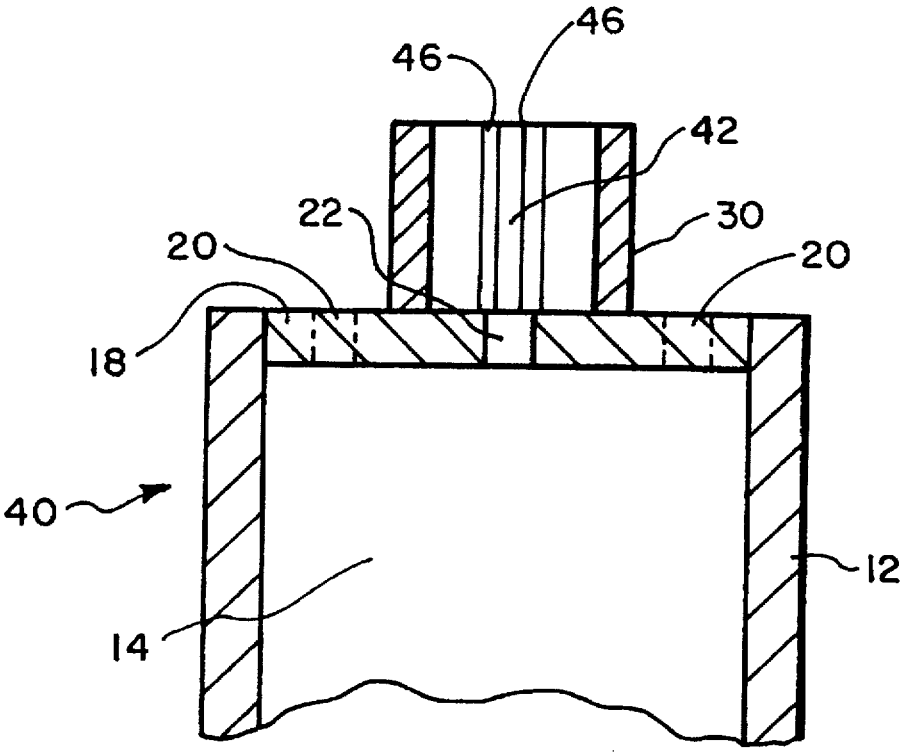
FIG. 6 is a sectional side view of a cable driving wrench assembly according to a second embodiment of the present invention.

FIGS. 6 and 7 illustrate a wrench assembly 40 according to a second embodiment of the present invention. The wrench assembly 40 is substantially similar to the wrench assembly 10 described above and includes a wrench body 12, open interior 14, closed end 16, second end 18, peripheral apertures 20, central aperture 22 and drive stub 24 substantially the same as described above. Additionally, the wrench assembly 40 includes a cable opening tool formed integral with the second end 18. Specifically, wrench assembly 40 has a rotatable tool body 30 attached to the second end 18 similar to that described above. The cable opening tool of wrench assembly 40 differs from the cable opening tool of wrench assembly 10 in the formation of socket 42. The socket 42 extends through the tool body 30 and is aligned with the central aperture 22 as shown in the drawings. The socket 42 is formed in the tool body 30 by three intersecting slots 44 formed in the tool body 30. The slots 44 are offset from each other 60°, thereby forming a central borehole and six peripheral projections 46 extending into the borehole. The slots 44 are formed on at least the top portion of the socket 42. If the slots 44 do not extend all the way through the tool body 30, then an additional aperture extends through the tool body 30 aligned with the central aperture 22.

The projections 46 formed by the three slots 44 are adapted to be received between adjacent outer peripheral strands of a multi-strand cable when the trailing end of the cable is received within the socket 42. The projections 46 thereby rotationally hold the cable relative to the tool body 30. Consequently, when the tool body 30 is rotated opposite to the direction of lay of the multi-strand cable and an upper portion of the cable is held against rotation (generally manually), the cable will open or separate at the trailing end substantially the same as described above in connection with FIG. 3. The slots 44 and projections 46 additionally allow the peripheral strands to move away from each other along the slots 44 during the opening of the cable, making the opening process easier. Additionally, the slots 44 are easily milled and provide a very cost effective way for forming the tool body 30. The operation of the wrench assembly 40 is substantially identical to the wrench assembly 10 described above.

Figure 9:
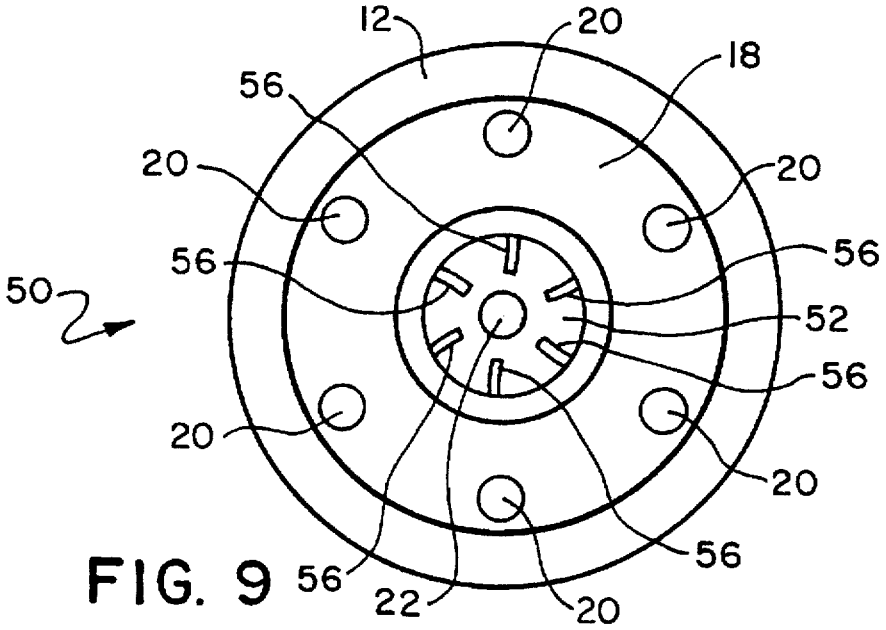
FIG. 9 is a top end view of the cable driving wrench assembly illustrated in FIG. 8.
Figure 8:
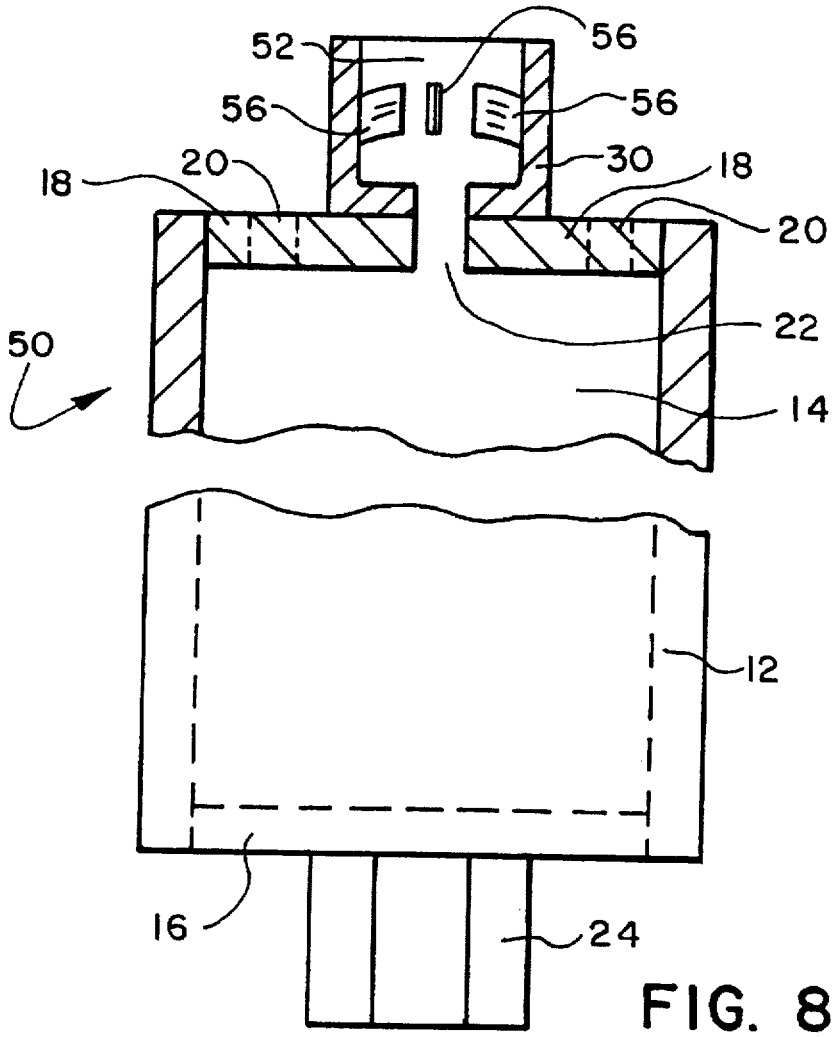
FIG. 8 is a sectional side view of a cable driving wrench assembly according to a third embodiment of the present invention.

FIGS. 8 and 9 illustrate a wrench assembly 50 according to a third embodiment of the present invention. The wrench assembly 50 is similar to the wrench assemblies 10 and 40 described above and includes a wrench body 12, open interior 14, closed end 16, second end 18, peripheral apertures 20, central aperture 22 and drive stub 24. Additionally, the wrench assembly 50 includes a cable opening tool formed integral with the second end 18. Specifically, the wrench assembly 50 has a tool body 30 attached to the second end 18. The wrench assembly 50 differs from the wrench assemblies 10 and 40 in the formation of socket 52 within the tool body 30. The socket 52 is formed with a borehole extending therethrough and aligned with the central aperture 22 as illustrated in FIGS. 8 and 9. The socket 52 additionally includes six points or projections 56 extending into the borehole. The projections 56 are adapted to be received between adjacent outer peripheral strands of the trailing end of the closed cable similar to the projections 46 described above in connection with wrench assembly 40. The projections 56 will rotationally hold the cable relative to the tool body 30 such that rotation of the tool body 30 opposite to the direction of lay of the individual strands together with maintaining an upper portion of the cable against rotation will result in opening of the individual strands of the trailing end of the cable substantially the same as the wrench assemblies 10 and 40 described above. As with wrench assembly 40, the use of projections 56 allows the open strands to separate slightly during the reverse rotation of the tool body 30, easing the opening of the trailing end of the cable. Projections 56 may be formed by welding appropriate elements on the interior of the socket 52 or, alternatively, the tool body 30 may be appropriately cast or otherwise machined. The wrench assembly 50 operates substantially the same as the wrench assemblies 10 and 40 described above.

Figure 10:
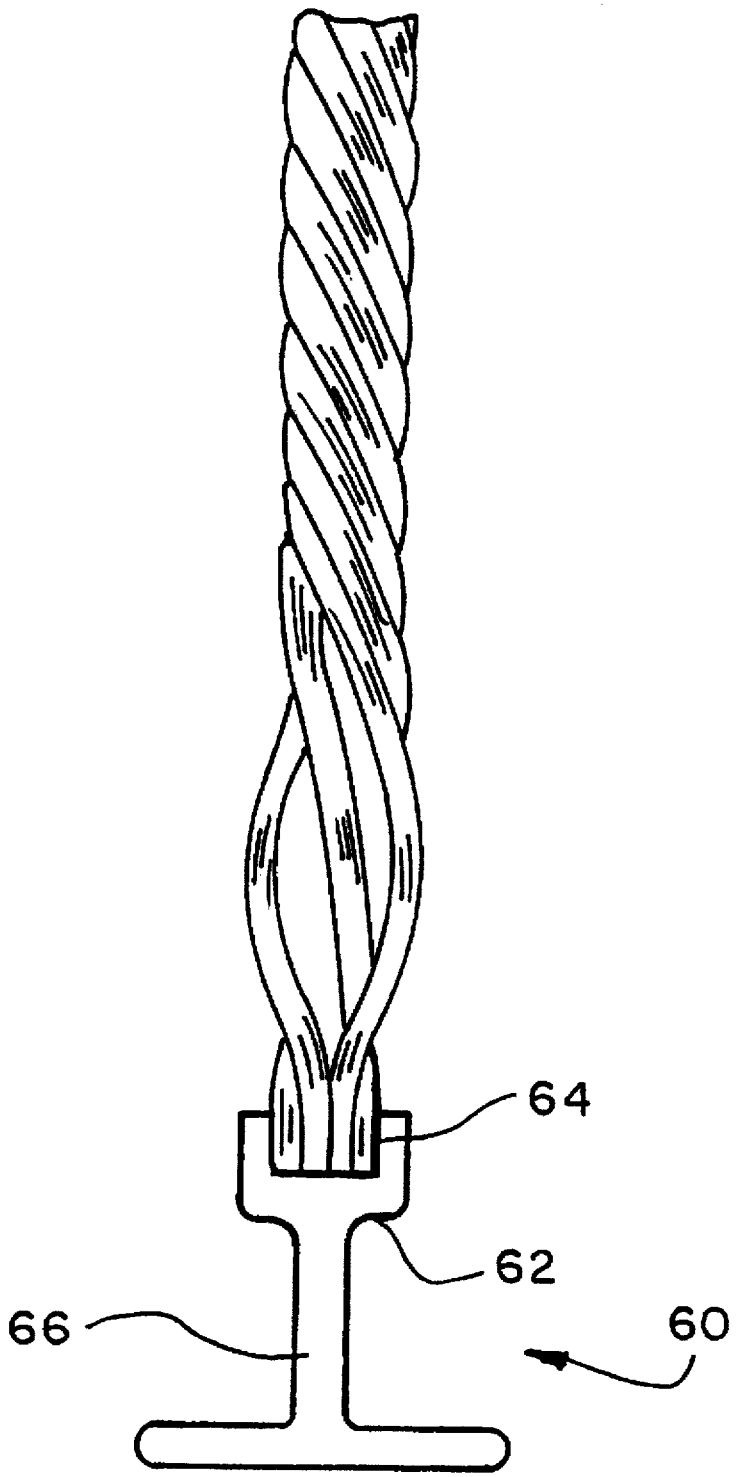
FIG. 10 is a schematic view of a multi-strand cable of a conventional cable mine rock anchor being twisted to open the individual strands thereof by a separate cable opening tool according to the present invention.

FIG. 10 schematically illustrates the operation of a separate manually operated cable opening tool 60. The cable opening tool 60 includes a tool body 62 with a socket 64 extending into the tool body 62. As illustrated in FIG. 10, the socket 64 is engageable with one end, generally a trailing end, of the multi-strand cable to separate the individual strands from each other at one end of the cable upon rotation of the tool body 62 in a direction opposite to the lay of the cable strands together with maintaining the cable against rotation. The tool body 62 additionally includes a manual handle 66 extending therefrom away from the socket 64 for ease of operation.

Figure 12:
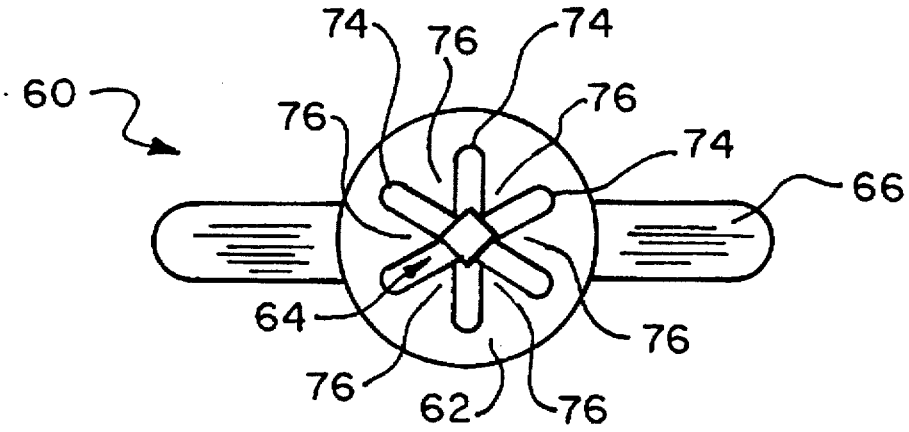
FIG. 12 is a top end view of the cable opening tool illustrated in FIG. 11.
Figure 11:
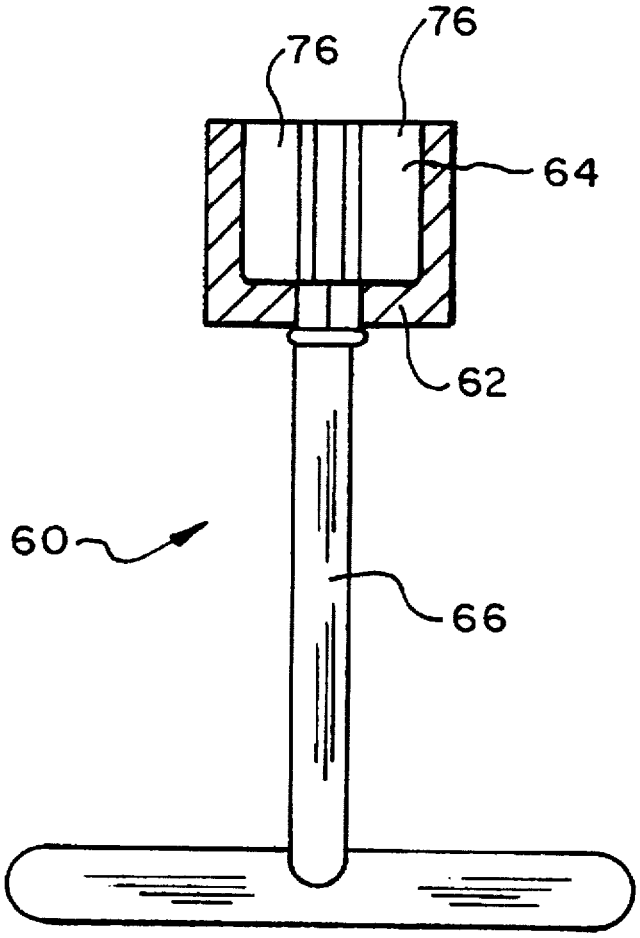
FIG. 11 is a sectional side view of one embodiment of the separate cable opening tool according to the present invention.

FIGS. 11 and 12 illustrate one embodiment of the cable opening tool 60 according to the present invention. The cable opening tool 60 illustrated in FIGS. 11 and 12 has a tool body 62 which forms the socket 64 with three intersecting slots 74 therein forming a center borehole and six projections 76 extending into the borehole. The slots 74 and projections 76 are substantially identical to the slots 44 and projections 46 formed in the tool body 30 of the wrench assembly 40 described above and operate in the same manner.

Figure 14:
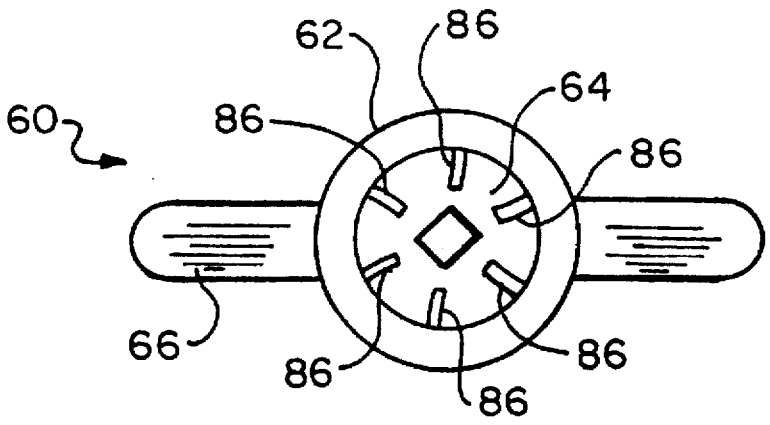
FIG. 14 is a top end view of the cable opening tool illustrated in FIG. 13.
Figure 13:
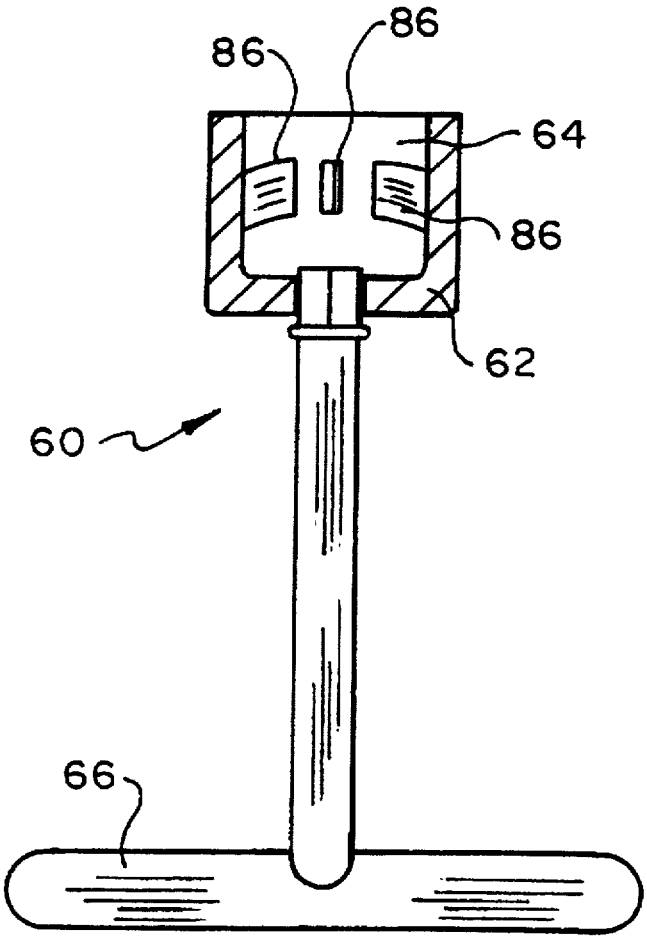
FIG. 13 is a sectional side view of a separate cable opening tool according to a second embodiment of the present invention.

FIGS. 13 and 14 illustrate a cable opening tool 60 according to the second embodiment of the present invention in which the tool body 62 has a socket 64 which includes a central borehole with projections 86 extending into the borehole of the socket 64. The socket 64 and projections 86 shown in FIGS. 13 and 14 are substantially the same as the socket 52 and projections 56 of the tool body 30 of the wrench assembly 50 described above and operate in the same manner. FIGS. 11–14 are merely intended to be illustrative examples of various socket configurations which can be utilized for forming a cable opening tool according to the aspects of the present invention.

The various socket configurations described herein are similar to those described in related co-pending U.S. patent application Ser. No. 08/601,991 entitled "CABLE BOLT DRIVER" filed on Feb. 15, 1996 which is incorporated herein by reference. The sockets 32, 42, 52 and 64 disclosed in the cable opening tools of the present invention all serve to hold the cable relative to the respective tool bodies 30 and 62. As described above, when the cable is held and the tool body 30 or 62 is rotated opposite to the direction of lay of the multi-strand cable, the individual strands of the cable are opened or separated. The rotation of the tool bodies 30 and 62 with the direction of lay of the multi-strand cable would impart a rotational torque to the cable as described in this related application. The wrench body 12 has an advantage over the use of the cable opening tool, as described herein, for imparting rotation to the cable itself in that the wrench body 12 works well with rotating a cable having a significant length of the cable extending out from the borehole.

It will be apparent to those of ordinary skill in the art that various changes and modifications may be made to the present invention without departing from the spirit and scope thereof. Consequently, the scope of the present invention is intended to be defined by the attached claims.

What is claimed is:

1. A cable driving wrench assembly for rotating a multi-strand cable rock anchor, said wrench assembly comprising:

a hollow, tubular wrench body having a first closed end, a second end spaced from said first closed end and an open interior;

a plurality of apertures in said second end of said wrench body extending into said open interior, each said aperture adapted to receive an individual strand of the multi-strand cable of the cable bolt when the individual strand is separated from the remaining strands of the cable at least at one end of the cable, and wherein said open interior of said wrench body is adapted to receive one end of the cable through said plurality of apertures; and a means for thrusting and rotating said wrench body attached to said wrench body.

2. The wrench assembly of claim 1 wherein said plurality of apertures includes six peripherally spaced apertures and a centrally positioned aperture.

3. The wrench assembly of claim 1 wherein said means for thrusting and rotating said wrench body includes a drive stub attached to said closed end of said wrench body.

4. The wrench assembly of claim 1 further including a cable opening tool having a socket formed in a rotatable tool body, said socket engageable with one end of the multi-strand cable to separate the individual strands from each other at one end of the cable upon rotation of said tool body.

5. The wrench assembly of claim 4 wherein said cable opening tool is attached to said wrench body.

6. The wrench assembly of claim 5 wherein said tool body is attached to said second end of said wrench body, and said socket extends through said tool body and is aligned with one of said plurality of apertures in said second end.

7. The wrench assembly of claim 6 wherein at least an upper portion of said socket includes six planar engaging faces.

8. The wrench assembly of claim 6 wherein said socket includes a borehole extending into said cable opening tool and a plurality of cable engaging projections extending into said borehole, each said projection adapted to be received between adjacent peripheral strands of the multi-strand cable.

9. The wrench assembly of claim 8 wherein said borehole and said socket are formed by three intersecting slots in said tool body.

10. The wrench assembly of claim 4 wherein at least an upper portion of said socket includes six planar cable engaging faces.

11. The wrench assembly of claim 4 wherein said socket includes a borehole extending into said tool body and a plurality of cable engaging projections extending into said borehole, each said projection adapted to be received between adjacent peripheral strands of the multi-strand cable.

12. The wrench assembly of claim 11 wherein said borehole and said projections are formed by three intersecting slots extending into said tool body.

* * * * *